US006910286B2

(12) United States Patent
Hwang

(10) Patent No.: US 6,910,286 B2
(45) Date of Patent: Jun. 28, 2005

(54) LAUNDRY DRYER

(75) Inventor: Sung Gi Hwang, Changwon-si (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 10/724,730

(22) Filed: Dec. 2, 2003

(65) Prior Publication Data

US 2004/0159010 A1 Aug. 19, 2004

(30) Foreign Application Priority Data

Dec. 2, 2002 (KR) ..... 10-2002-0075981

(51) Int. Cl.[7] ..... F26B 11/02
(52) U.S. Cl. ..... 34/601; 34/603
(58) Field of Search ..... 68/139, 140; 34/601, 34/602, 603

(56) References Cited

U.S. PATENT DOCUMENTS 5,860,300 A * 1/1999 Valent ..... 68/24
6,256,823 B1 * 7/2001 Kronbetter et al. ..... 8/158
6,474,351 B1 * 11/2002 Cerruti et al. ..... 134/99.2
6,761,049 B2 * 7/2004 Nitschmann et al. ..... 68/5 E

* cited by examiner

*Primary Examiner*—Denise L. Esquivel
*Assistant Examiner*—Kathryn S. O'Malley
(74) *Attorney, Agent, or Firm*—Birch, Stewart, Kolasch & Birch, LLP

(57) ABSTRACT

A door sealing assembly in a laundry dryer having a hinged door employs a unified sealing member provided as a single sealing member including a large diameter part, a small diameter part, a tip and a lip disposed in correspondence to the various components of the laundry dryer. The reduced number of sealing members improves the sealing properties of the door sealing assembly, simplifies fabrication, and reduces production cost. The laundry dryer includes a door frame, the door frame being provided with a door glass; a frame cover having a frame cover panel in which an entrance hole is formed for receiving the door frame, the frame cover panel having an inner end surface; a front support, coupled with the frame cover, for supporting a drum, the front support having a front support panel having an inner end surface; and a unified sealing member, fixed to the inner end surfaces of the frame cover panel and the front support panel, providing for simultaneous contact with surfaces of the door frame and the door glass when the hinged door is closed.

14 Claims, 4 Drawing Sheets

LAUNDRY DRYER

This application claims the benefit of Korean Application No. 10-2002-0075981 filed on Dec. 2, 2002, which is hereby incorporated by reference.

BACKGROUND OF THE INVENTION

1. Field of the Invention

The present invention relates to a laundry dryer, and more particularly, to a laundry dryer employing a unified sealing means in a door sealing assembly of the laundry dryer.

2. Discussion of the Related Art

Generally speaking, a laundry dryer performs the drying of laundry using hot air circulating within a sealed space, which is in essence a drum having an entrance provided with a hinged door for accessing the drum. Typically, the door is provided with a glass window for observing the status of the drum's interior. During drying, hot and humid air is contained under an airtight seal between the various components of the laundry dryer, including the door, the glass window of the door, and components forming the front surface of the drum. Such a laundry dryer is illustrated in FIG. 1.

Referring to FIG. 1, a laundry dryer comprises a cabinet frame 11 forming the body of the laundry dryer and a frame cover 14 forming the front surface of the cabinet and having an entrance hole where a door frame 15 is installed. The door frame 15 has a door glass 15*a* through which a user can observe the state of drying. A drum 20 is mounted within the cabinet frame 11, and the front side of the drum is secured to the frame cover 14 using a front support 22 coupled to the frame cover.

During operation, the air circulating within the closed space, formed by the door frame 15 and door glass 15*a* closing the entrance hole of the frame cover 14 connected to the front support 22, may escape through gaps between the above-mentioned components of the laundry dryer. Accordingly, a laundry dryer according to a related art is provided with a door sealing assembly, as shown in FIG. 2.

Referring to FIG. 2, a door sealing assembly is provided three separate seals or gaskets for establishing an airtight seal between respective components, namely, a first sealing member 41 for sealing a gap between the door frame 15 and door glass 15*a*, a second sealing member 42 for sealing a gap between the door frame 15 and a frame cover panel 14*a* of the frame cover 14, and a third sealing member 43 for sealing a gap between the frame cover panel and a front support panel 22*a* of the front support 22. In doing so, however, three distinctly shaped sealing members are required, which complicates fabrication and increases production costs accordingly. Moreover, with the use of multiple sealing members, there is an inherent increase in the probability of a leak to occur.

SUMMARY OF THE INVENTION

Accordingly, the present invention is directed to a laundry dryer that substantially obviates one or more of the problems due to limitations and disadvantages of the related art.

An object of the present invention, which has been devised to solve the foregoing problem, lies in providing a laundry dryer, by which the sealing properties of a door sealing assembly are improved while simplifying fabrication and reducing production cost.

It is another object of the present invention to provide a laundry dryer having a door sealing assembly in which a unified sealing member is used to perform the necessary sealing actions.

Additional features and advantages of the invention will be set forth in the description which follows, and in part will be apparent to those having ordinary skill in the art upon examination of the following or may be learned from a practice of the invention. The objectives and other advantages of the invention will be realized and attained by the subject matter particularly pointed out in the specification and claims hereof as well as in the appended drawings.

To achieve these objects and other advantages in accordance with the present invention, as embodied and broadly described herein, there is provided a laundry dryer having a sealing assembly for a hinged door, the laundry dryer comprising a door frame, the door frame being provided with a door glass; a frame cover having a frame cover panel in which an entrance hole is formed for receiving the door frame, the frame cover panel having an inner end surface; a front support, coupled with the frame cover, for supporting a drum, the front support having a front support panel having an inner end surface; and a unified sealing member, fixed to the inner end surfaces of the frame cover panel and the front support panel, providing for simultaneous contact with surfaces of the door frame and the door glass when the hinged door is closed.

It is to be understood that both the foregoing explanation and the following detailed description of the present invention are exemplary and illustrative and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE PREFERRED EMBODIMENT

Reference will now be made in detail to the preferred embodiment of the present invention, examples of which are illustrated in the accompanying drawings.

Figure 1:
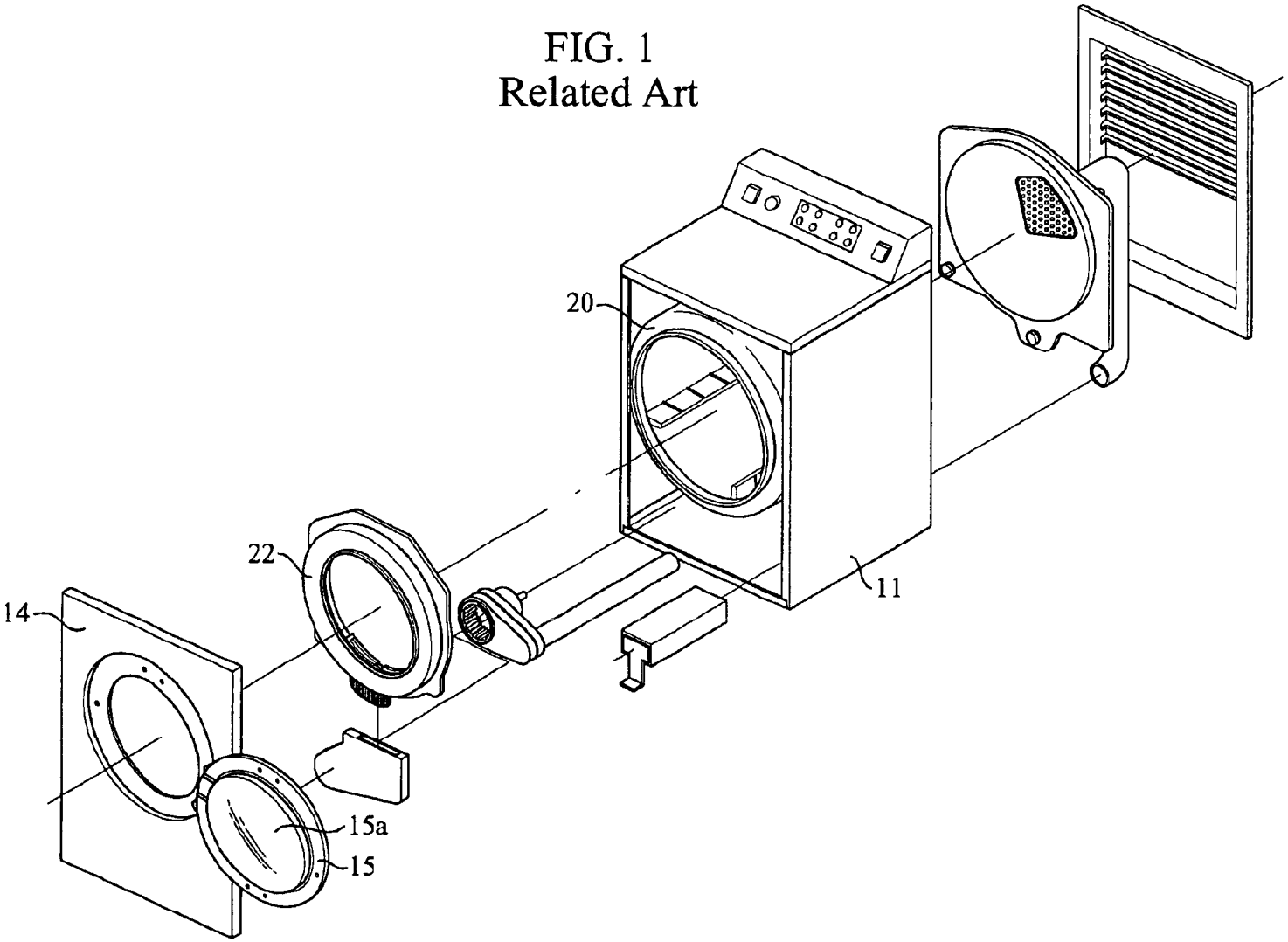
FIG. 1 Related Art
FIG. 1 is an exploded perspective view of a general laundry dryer.
Figure 2:
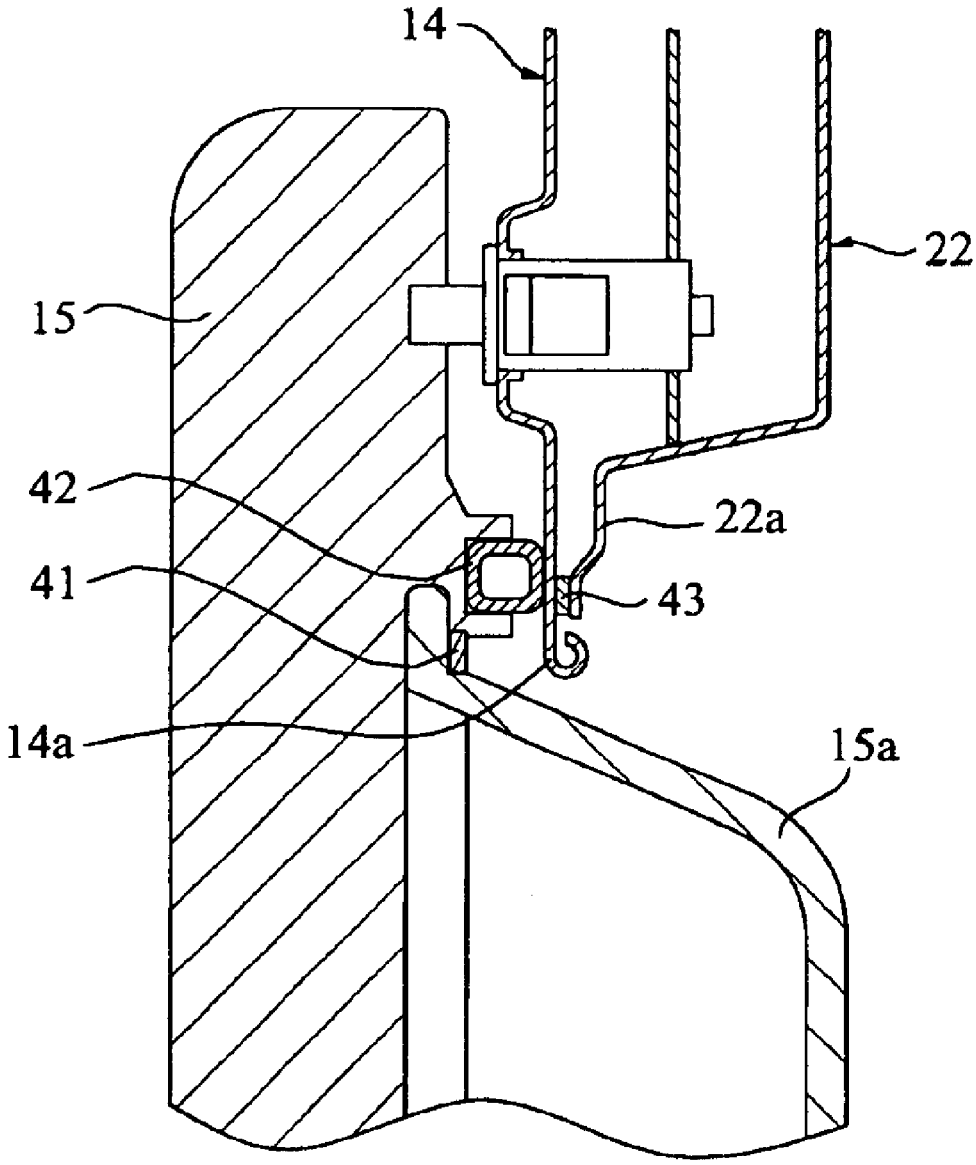
FIG. 2 Related Art
FIG. 2 is a cross-sectional view of a door sealing assembly of a laundry dryer according to a related art.
Figure 3:
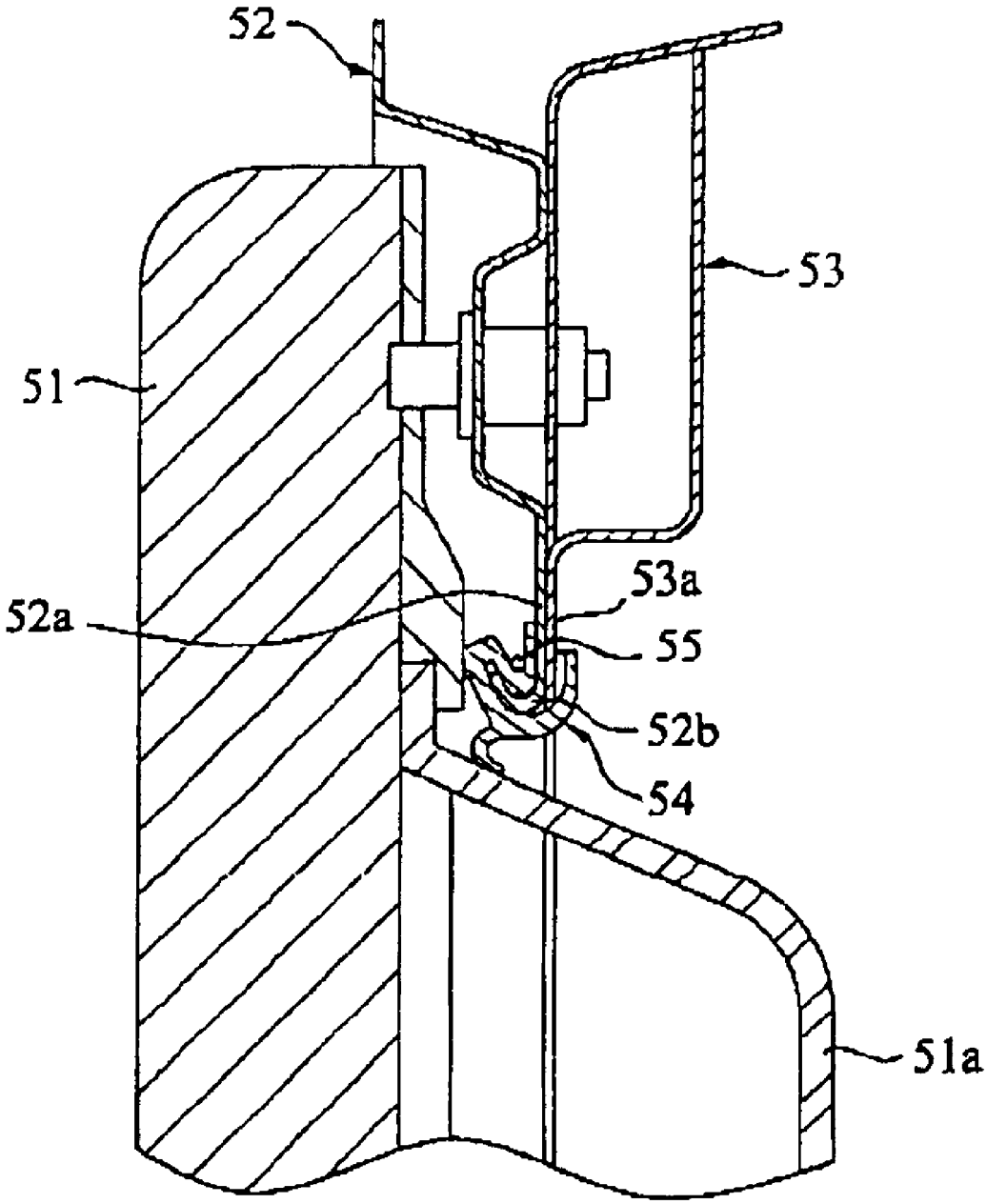
FIG. 3 is a cross-sectional view of a door sealing assembly of a laundry dryer according to the present invention.

Referring to FIG. 3, a laundry dryer according to the present invention is provided with a frame cover 52 having a frame cover panel 52*a* having a rolled inner end 52*b*, a door frame 51 with a door glass 51*a*, a front support 53 having a front support panel 53*a*, a unified sealing member 54, and a fixing bar 55. The frame cover 52, which provides the front cover of the cabinet frame (shown in FIG. 1) and is coupled to the front support 53, has an entrance hole for receiving the door frame 51 with the door glass 51*a* through which a user may observe the state of drying. The front support 53 provides support for the front end of the drum (shown in FIG. 1) to be mounted to the frame cover 52. The unified sealing member 54 is a single gasket piece fixed to inner end surfaces of the frame cover panel 52*a* of the frame cover 52 and the front support panel 53*a* of the front support 53, while providing for simultaneous contact with surfaces of both the door frame 51 and the door glass 51*a*. The fixing bar 55 is provided to press and fix the unified sealing-member 54 to the frame cover panel 52*a*.

Figure 4:
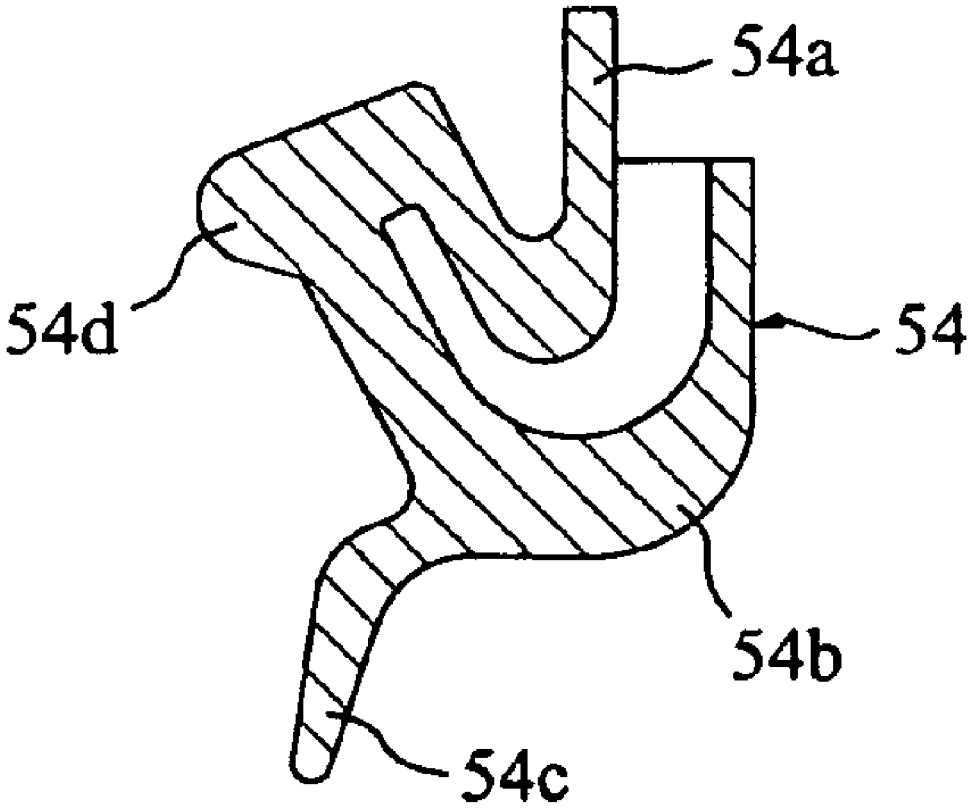
FIG. 4 is a cross-sectional view of the sealing member of FIG. 3.

Referring to FIG. 4, the unified sealing member 54 comprises a small diameter part 54*a* for receiving the fixing bar 55, a large diameter part 54*b* for receiving the rolled inner end 52*b* of the frame cover panel 52*a* of the frame cover 52, a lip 54*c* protruding from one side of the large diameter part, and a tip 54*d* protruding from a juncture of the large and small diameter parts. The small diameter part 54*a*, large diameter part 54*b*, lip 54*c*, and tip 54*d* are integrally formed of a pliable material such as soft rubber. When the door of the laundry dryer is closed, the tip 54*d* is in pliant contact with the door frame 51 and the lip 54*c* is in pliant contact with the door glass 51*a*. The rolled inner end 52*b* of the frame cover panel 52*b* is curved toward the door frame 51, and the fixing bar 55 presses and fixes the small diameter part 54*a* to the rolled inner end.

In the door sealing assembly of the laundry dryer according to the present invention, the unified sealing member 54 is provided at the gaps between the door frame 51 and door glass 51*a*, the door frame 51 and frame cover 52, and the frame cover 52 and front support 53, whereby air is prevented from escaping when the door is closed during operation. At the time of assembly, the respective inner ends of the frame cover panel 52*a* and the support cover panel 53*a* are inserted in a space of the unified sealing member 54, between the small diameter part 54*a* and the large diameter part 54*b*, thereby sealing the gap between the frame cover 52 and the front support 53; and the rolled inner end 52*b* of the frame cover panel 52*a* is inserted over the small diameter part 54*a* of the unified sealing member 54, thereby sealing the gap between the door frame 51 and the frame cover 52. When the door is closed, the gap between the door frame 51 and the front frame 52 is sealed by the tip 54*d* of the unified sealing member 154 making contact with the door frame 51. The seal between the door frame 51 and the front frame 52 is facilitated by the fixing bar 55 pressing and fixing the small diameter part 54*a* of the unified sealing member 54 to the rolled inner end 52*b* of the frame cover panel 52*a*. The seal between the door frame 51 and the door glass 51*a* is maintained, when the door is closed, by the tip 54*d* being in contact with the door frame, and the lip 54*c* being in contact with the door glass.

By adopting the door sealing assembly as described above in a laundry dryer according to the present invention, the unified sealing member 54 provided as a single sealing means including the large diameter part 54*b*, small diameter part 54*a*, tip 54*d*, and lip 54*c* is disposed in correspondence to the various components of the laundry dryer. Accordingly, the reduced number of sealing members improves the sealing properties of the door sealing assembly, simplifies fabrication, and reduces production cost.

It will be apparent to those skilled in the art that various modifications and variations can be made in the present invention without departing from the spirit or scope of the invention. Thus, it is intended that the present invention cover such modifications and variations, provided they come within the scope of the appended claims and their equivalents.

What is claimed is:

1. A laundry dryer having a sealing assembly for a hinged door, the laundry dryer comprising:

a door frame, said door frame being provided with a door glass;

a frame cover having a frame cover panel in which an entrance hole is formed for receiving said door frame, the frame cover panel having an inner end surface;

a front support, coupled with said frame cover, for supporting a drum, the front support having a front support panel having an inner end surface; and a unified sealing member, fixed to the inner end surfaces of the frame cover panel and front support panel, said unified sealing member contacting the front support panel, while simultaneously contacting surfaces of said door frame and said door glass when the hinged door is closed.

2. The laundry dryer as claimed in claim 1, said unified sealing member comprising:

a small diameter part for receiving an inner end of the frame cover panel;

a large diameter part, disposed so as to create a space with respect to said small diameter part, the created space for receiving the inner end surfaces of the frame cover panel and front support panel;

a tip, protruding from a juncture of said large diameter part and small diameter part, said tip being in pliant contact with said door frame when the hinged door is closed; and a lip, protruding from one side of said large diameter part, said lip being in pliant contact with the door glass of said door frame when the hinged door is closed.

3. The laundry dryer as claimed in claim 2, wherein the inner end of the frame cover panel of said frame cover is formed as a rolled inner end.

4. The laundry dryer as claimed in claim 3, wherein the rolled inner end is curved toward said door frame.

5. The laundry dryer as claimed in claim 3, further comprising a fixing bar for pressing and fixing said small diameter part of said unified sealing member to the rolled inner end of the frame cover panel of said frame cover.

6. The laundry dryer as claimed in claim 1, wherein said unified sealing member also contacts the frame cover panel.

7. A laundry dryer comprising:

a door frame;

a frame cover having a frame cover panel in which an entrance hole is formed for receiving said door frame, the frame cover panel having an inner end surface;

a front support, coupled with said frame cover, for supporting a drum, the front support having a front support panel having an inner end surface; and a unified sealing member, fixed to the inner end surfaces of the frame cover panel and front support panel, said unified sealing member contacting the frame cover panel and front support panel while simultaneously contacting a surface of said door frame.

8. The laundry dryer as claimed in claim 7, said unified sealing member comprising:

a small diameter part for receiving an inner end of the frame cover panel;

a large diameter part, disposed so as to create a space with respect to said small diameter part, the created space for receiving the inner end surfaces of the frame cover panel and front support panel; and a tip, protruding from a juncture of said large diameter part and small diameter part, said tip being in pliant contact with said door frame when the hinged door is closed.

9. The laundry dryer as claimed in claim 8, wherein the inner end of the frame cover panel of said frame cover is formed as a rolled inner end.

10. The laundry dryer as claimed in claim 9, wherein the rolled inner end is curved toward said door frame.

11. The laundry dryer as claimed in claim 8, further comprising a fixing bar for pressing and fixing said small diameter part of said unified sealing member to the rolled inner end of the frame cover panel of said frame cover.

12. The laundry dryer as claimed in claim 7, wherein said unified sealing member includes a lip contacting a window portion of said door frame.

13. The laundry dryer as claimed in claim 7, wherein said unified sealing member includes two J-configured parts connected to each other.

14. The laundry dryer as claimed in claim 13, wherein said unified sealing member further includes two protrusion parts provided respectively at front portions of the two J-configured parts.

* * * * *